US005732835A

United States Patent [19]

Morita et al.

[11] Patent Number: 5,732,835

[45] Date of Patent: Mar. 31, 1998

[54] CRANE CONTROL DEVICE

[75] Inventors: Tadashi Morita, Hiratsuka; Seiichi Mizui, Odawara, both of Japan

[73] Assignee: Komatsu Ltd., Tokyo, Japan

[21] Appl. No.: 666,382

[22] PCT Filed: Dec. 6, 1994

[86] PCT No.: PCT/JP94/02045

§ 371 Date: Jun. 18, 1996

§ 102(e) Date: Jun. 18, 1996

[87] PCT Pub. No.: WO95/18060

PCT Pub. Date: Jul. 6, 1995

[30] Foreign Application Priority Data

Dec. 28, 1993 [JP] Japan ..... 5-337461

[51] Int. Cl.[6] ..... B66C 15/06

[52] U.S. Cl. ..... 212/278; 340/685

[58] Field of Search ..... 212/278, 280; 340/685

[56] References Cited

U.S. PATENT DOCUMENTS 4,185,280 1/1980 Wilhelm ..... 340/685

4,532,595 7/1985 Wilhelm ..... 340/685

4,752,012 6/1988 Juergens ..... 212/278

5,160,056 11/1992 Yoshimatsu et al. ..... 212/278

5,217,126 6/1993 Hayashi et al. ..... 212/278

5,282,136 1/1994 Zui et al. ..... 340/685

FOREIGN PATENT DOCUMENTS 52-135150 11/1977 Japan .

58-95095 6/1983 Japan .

*Primary Examiner*—Thomas J. Brahan

*Attorney, Agent, or Firm*—Baker & Daniels

[57] ABSTRACT

An object of this invention is to improve safety in a crane. A boom control signal αr and a winch control signal βr are simultaneously outputted to, respectively, a boom drive portion and a winch drive portion of a driving portion 30 for obtaining, respectively, target values Xr, Yr, with current working radius X and lift Y that vary according to the flexure of boom 4 as feedback amounts, thereby a boom hoisting angle and a rope length being controlled simultaneously.

4 Claims, 3 Drawing Sheets

CRANE CONTROL DEVICE

TECHNICAL FIELD

The present invention relates to a device for controlling the boom hoisting angle and the length of a wind-up rope such that the working radius of the crane or its lift have desired fixed values.

BACKGROUND ART

When a crane is performing a so-called ground-departing operation, it is desirable that the crane is operated such that the working radius indicating the horizontal distance from the rotation center of the crane to the tip of the boom is a desired fixed value.

However, when departing from the ground, the load acting on the boom increases as the hook on which the load is suspended is raised, causing the boom to flex and thereby increasing the working radius. Conversely, when performing an operation such as pouring fresh concrete, the suspended load decreases, thus decreasing the boom load and so decreasing the working radius.

Accordingly, when performing operations in which the flexure of the boom fluctuates as described above, the exercise of control such as to maintain the working radius at a fixed value is desirable from the standpoint of increasing ease of working by improving the accuracy of tracking and also from the standpoint of improving safety by preventing accidents involving contact due to flow of the load.

In some cases, cranes are used to perform horizontal movement operations in which the suspended load is shifted in the horizontal direction while maintaining the lift indicating the vertical distance from the ground to the hook at a fixed value.

In such cases also, the amount of boom flexure fluctuates with the horizontal movement of the suspended load, so exercise of control such as to keep the lift fixed irrespective of such fluctuations in the flexure of the boom is desirable both to improve ease of working as mentioned above and to improve safety.

Conventionally therefore arrangements have been made to compensate for fluctuation in the working radius produced by fluctuation in boom flexure by calculating the amount of flexure produced in the boom and by varying the boom hoisting angle in accordance with the results of this calculation (Japanese Patent Publication Sho.59-26599, Laid-Open Japanese Patent Application Hei. 1-256496, and Laid-Open Japanese Patent Application Hei.3-284598, etc).

However, although the prior art, in which only the boom hoisting angle was changed in order to remove fluctuations of the working radius, did indeed succeed in removing fluctuations of the working radius itself it tended to produce concurrent fluctuations in lift, sometimes resulting in the dangerous condition that the suspended load might spring up abruptly in combination with raising of the boom.

Also, similar problems regarding safety were produced when the prior art was applied to performing operations in which the lift must be kept at a fixed value.

The present invention was made after considering the above circumstances, and its object is to perform in a safe manner an operation that advances by varying the lift while keeping the working radius constant or an operation that advances by varying the working radius while keeping the lift constant.

DISCLOSURE OF THE INVENTION

Accordingly, the present invention comprises boom drive means for changing a boom hoisting angle in response to an input drive instruction; winch drive means for changing a rope length of the wind-up rope from a tip of the boom to a hook in response to the input drive instruction; and control means for outputting drive instructions respectively to the boom drive means and winch drive means such as to effect a prescribed operation in which a lift, indicating the vertical distance from the ground to the hook, is varied, while maintaining the working radius, indicating the horizontal distance from the rotation center of the crane to the boom tip, at a fixed value.

Also, the present invention comprises boom drive means for changing the boom hoisting angle in response to an input drive instruction; winch drive means for changing the rope length of the wind-up rope from the boom tip to the hook in response to an input drive instruction; and control means for outputting drive instructions respectively to the boom drive means and winch drive means such as to perform a prescribed operation by varying the working radius indicating the horizontal distance from the rotation center of the crane to the boom tip while maintaining the lift indicating the vertical distance from the ground to the hook at a fixed value.

With such a construction, according to the present invention, as shown in FIG. 1, the hoisting angle $\alpha$ of boom 4 is varied in response to a drive instruction $\alpha r$ that is input to boom drive means 30.

In contrast, rope length $\beta$ of the wind-up rope 8 from the boom tip 4*a* to hook 9 is varied in response to drive instruction $\beta r$ that is input to winch drive means 30.

Control means 20 outputs drive instructions $\alpha r$, $\beta r$ to the boom drive means 30 and winch drive means 30 such as to perform a prescribed operation while maintaining the working radius X indicating the horizontal distance from the rotation center of the crane to the boom tip 4*a* at a fixed value, and varying the lift Y indicating the vertical distance from the ground to hook 9.

Alternatively, control means 20 outputs drive instructions $\alpha r$, $\beta r$ to the boom drive means 30 and winch drive means 30 such as to perform a prescribed operation while maintaining lift Y at a fixed value and changing the working radius X.

BEST MODE FOR CARRYING OUT THE INVENTION

An embodiment of a crane control device according to the present invention is described below with reference to the drawings.

Figure 1:
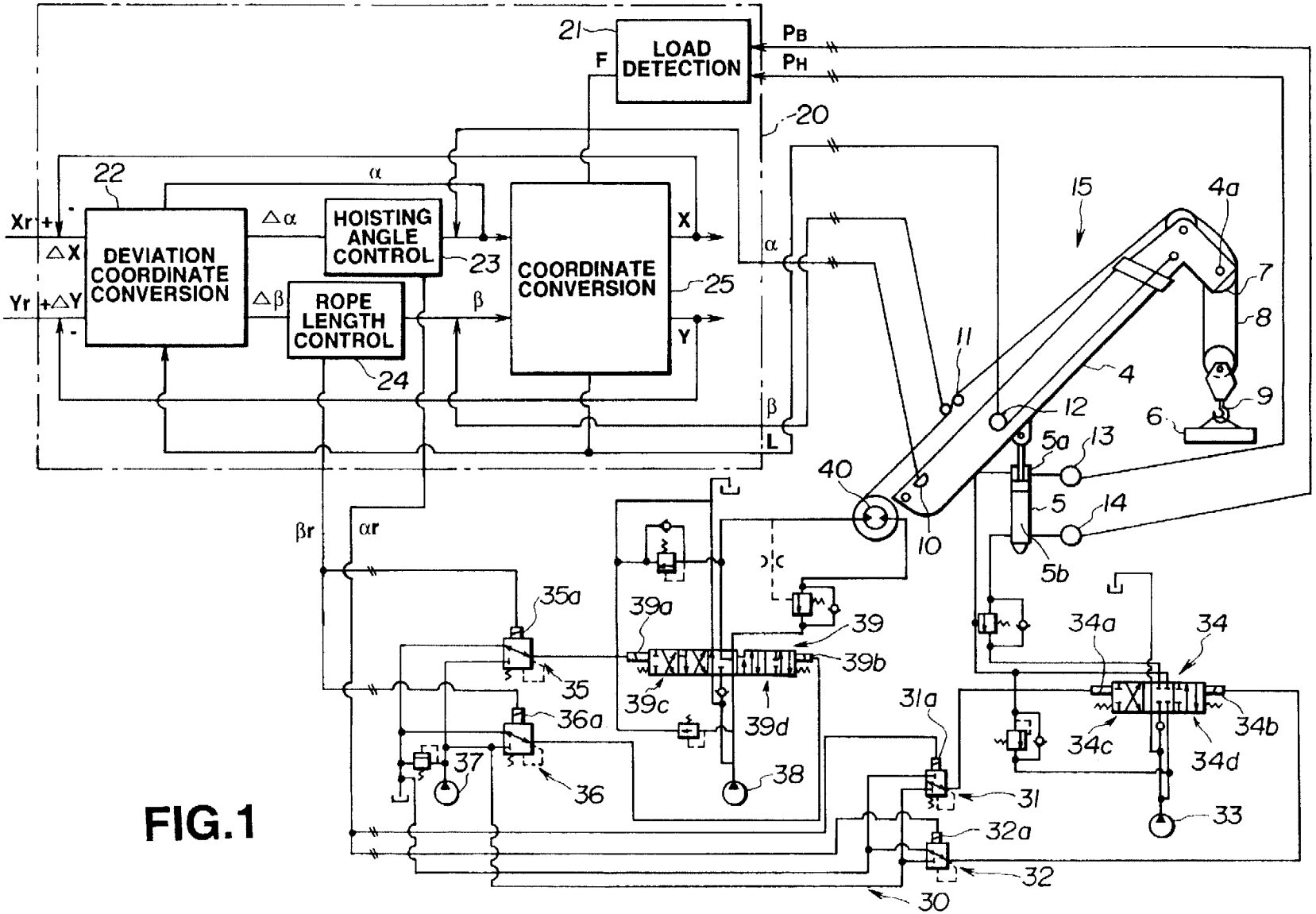
FIG. 1 is a block diagram showing the overall layout of an embodiment of a crane control device according to the present invention.

FIG. 1 is a block diagram illustrating the overall layout of the embodiment; in broad terms it consists of a sensor unit 15 arranged on the crane and comprising sensors 10 etc that detect the amounts of conditions necessary for control, a control unit 20 that inputs the detected values of sensor unit 15 and that generates control signals $\alpha r$, $\beta r$ for drive control of the boom 4 and winch, and a drive unit 30 that inputs control signals $\alpha r$, $\beta r$ that are output from control unit 20 and that drives by hydraulic pressure the boom and winch of the crane, performing for example processing such as conversion from the required electrical signals to hydraulic signals.

Figure 3:
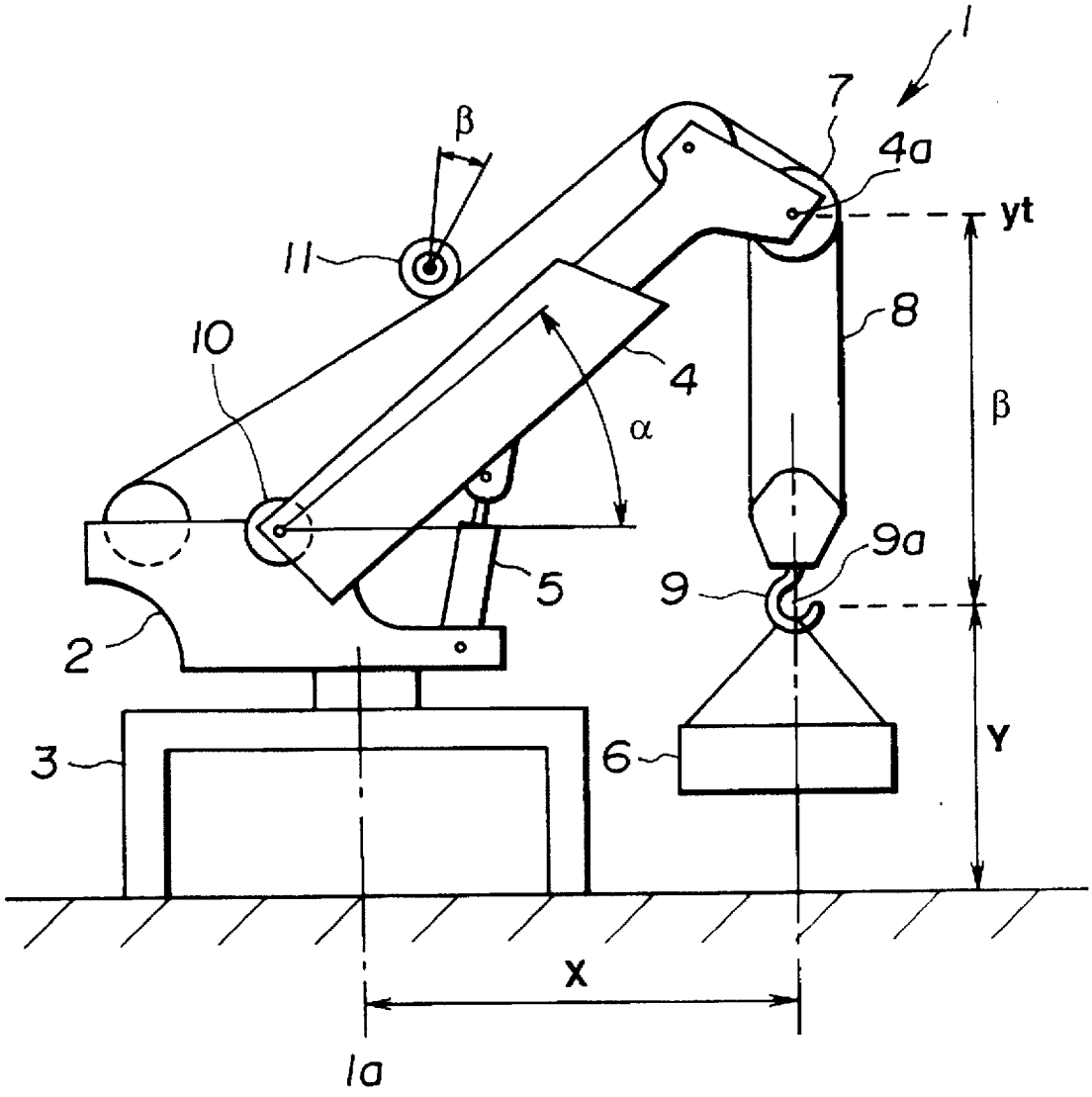
FIG. 3 is a side view showing the layout of a crane employed in the embodiment.

FIG. 3 is a side view showing the external appearance of crane 1 employed in the embodiment; as shown in this Figure, it illustrates a condition in which the bottom mechanism is arranged on the ground by means of an outrigger 3. At the top of the bottom mechanism, there is freely rotatably arranged an upper rotary element 2 constituting a revolver frame; a boom 4 is freely rotatably journalled by means of a rotary pin on this rotary element 2 such that boom 4 can move vertically.

The hoisting angle α of boom 4 is detected by means of a prescribed boom hoisting angle sensor 10 such as a variable resistor or rotary encoder mounted on the rotary pin. Boom 4 is driven by an actuator constituted by a hydraulic cylinder 5; a detailed description of the construction of the boom drive unit that drives boom 4 will be given later.

A wind-up rope 8 provided with a hook 9 at its tip is arranged on boom 4 so as to be free to wind up or lower hook 9, by means of a plurality of guide sheaves including a guide sheave 7 that is arranged at the top of boom 4. A prescribed suspended load 6 is engaged by hook 9.

The distance between the position 4*a* of the tip of boom 4 and the center position 9*a* of hook 9 below it is defined as rope length β. Rope length β is detected by a prescribed rope length sensor 11 such as a rotary encoder that outputs rope length β by detecting rotation of sheave 7. Winding up and lowering of winding-up rope 8 is effected by an actuator constituted by hydraulic motor 40 (see FIG. 1); the details of the construction of the winch drive unit will be described later. In this embodiment, working radius X, which is the horizontal distance between rotation center 1*a* of crane 1 and the center position 9*a* of the hook, is taken as a control variable, and lift Y, which is the vertical distance between the ground and the center position 9*a* of the hook is taken as a control variable. If the height yt of the boom tip position 4*a* is known, lift Y can easily be obtained by adding rope length β to this yt.

Also, in this embodiment, a crane is assumed whereof the length L of boom 4 can be varied; this boom length L is detected by a boom length sensor 12 (see FIG. 1). It may be noted that the present invention could of course be applied to a crane with a fixed boom length L; in this case, the boom length L is known, so there is no need to provide a boom length sensor 12.

Also, as shown in FIG. 1, on hydraulic cylinder 5 there are arranged pressure sensors 13, 14 to detect the load F applied to boom 4 and to detect the pressure of the pressurized oil of the oil chamber of hydraulic cylinder 5. Pressure sensor 13 is a sensor that detects the head pressure PH of retraction chamber 5*a* of cylinder 5; pressure sensor 14 is a sensor that detects the bottom pressure PB of expansion chamber 5*b* of cylinder 5.

As shown in FIG. 1, the detected values α, β, L and PH, PB of boom hoisting angle sensor 10, rope length sensor 11, boom length sensor 12 and pressure sensors 13 and 14 are input to control unit 20.

Figure 2:
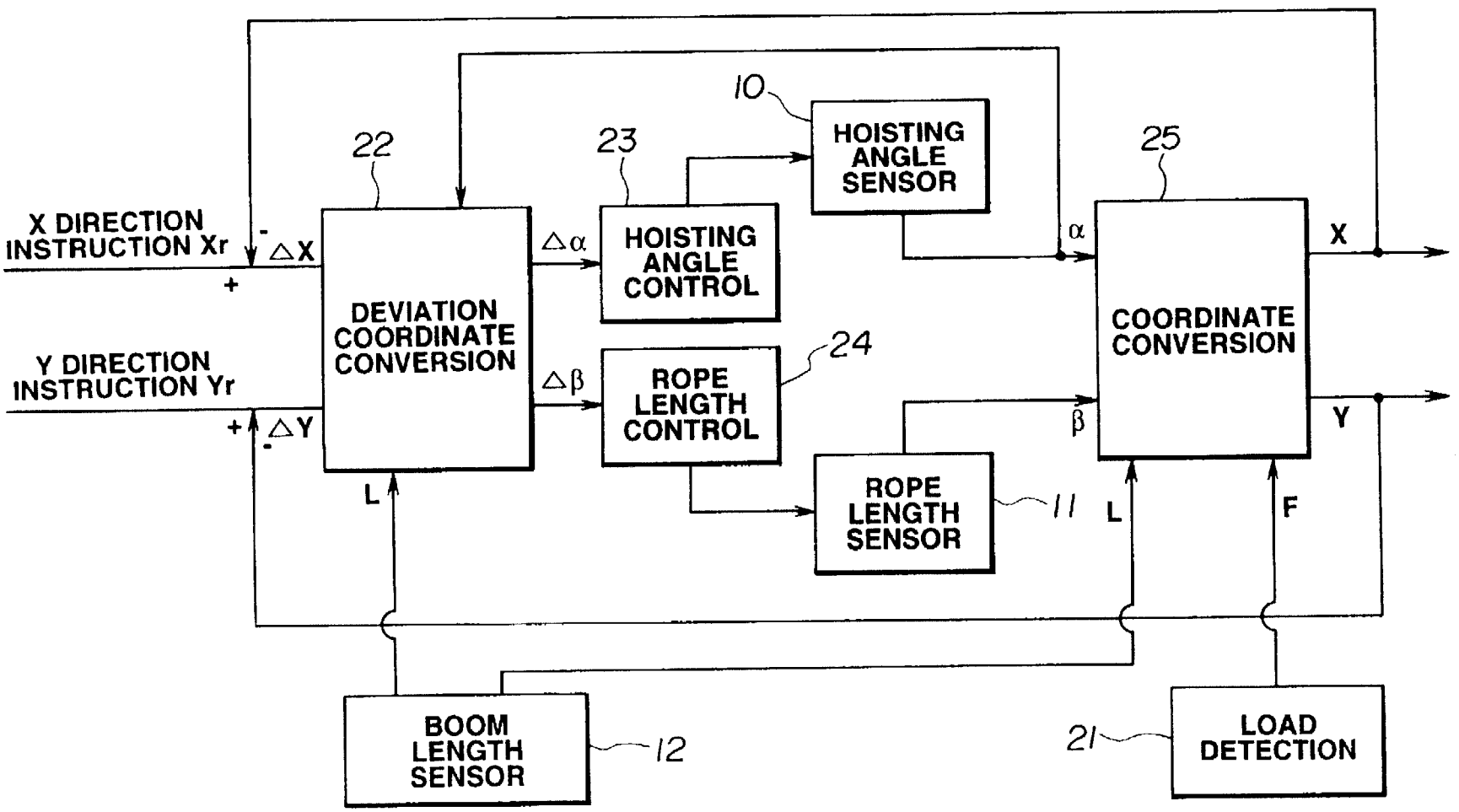
FIG. 2 is a view showing the control block diagram of the embodiment.

FIG. 2 is a control block diagram of the control block constituted by sensor unit 15 and control unit 20 shown in FIG. 1; as shown in this Figure, first of all, the load F acting on boom 4 is calculated and detected by load detection unit 20 using the outputs PH, PB of pressure sensors 13, 14.

Incidentally, when the flexure of boom 4 changes, working radius X changes in response to this change. Likewise, boom tip height yt also changes in response to the boom flexure.

It is known that the boom flexure changes with the boom hoisting angle a, boom load F and boom length L as parameters. There is therefore a prescribed correspondence relationship indicated by function f shown below between working radius X and these parameters α, F and L.

$$X=f(\alpha,F,L) \tag{1}$$

Likewise, there is a prescribed correspondence relationship indicated by function g between the boom tip height yt and the above parameters α, F and L.

$$yt=g(\alpha,F,L) \tag{2}$$

The correspondence relationship between these parameters α, etc. and working radius X and the correspondence relationship between these parameters α, etc and boom tip height yt can be determined beforehand by experiment or simulation, etc and is stored in prescribed memory in the form of a calculation formula or in the form of a table.

In this way, the current working radius X taking into account the flexure of boom 4 can be calculated from the correspondence relationship indicated by formula (1) above, and the current boom tip height yt taking into account the flexure of boom 4 can be calculated from the correspondence relationship indicated by formula (2) above.

Now boom 4 and the winch are driven by operation of operating levers etc by the operator of crane 1 and a target value Xr of working radius X corresponding to such lever operation etc is input to control unit 20 and a target value Yr of lift Y is input to the same control unit Yr.

Coordinate conversion section 25 calculates the current working radius X, which is the value of the function corresponding to function f by substituting the detected values α and L of sensors 10 and 12 that are currently input, and the calculated value F of load detection section 21 into formula (1). In the same way, the current boom tip height yt, which is the function value corresponding to function g, is calculated by substituting the input detected values α and L of sensors 10 and 12, and the calculated value F of load detection section 21, into formula (2). In addition, the current lift Y is calculated by adding the detected value β of the rope length sensor 11 that is currently input to boom tip height yt that is thus calculated.

When this is done, the deviation ΔX between the working radius target value Xr that is currently input as operating output of an operating lever or the like and the current working radius X (feedback value) that is calculated by coordinate conversion section 25, and this working radius deviation ΔX is input to deviation coordinate conversion section 22.

In the same way, the deviation ΔY between the lift target value Xr that is currently input as operating output of an operating lever or the like and the current lift Y (feedback amount) calculated by coordinate conversion section 25 is found and this lift deviation ΔY is input to deviation coordinate conversion section 22.

Deviation coordinate conversion section 22 uses the input working radius deviation ΔX, the lift deviation ΔY, the detected value a of boom hoisting angle sensor 10, and the detected value L of boom length sensor 12 to calculate the deviation Δα of the boom hoisting angle corresponding to working radius deviation ΔX, and to calculate the deviation Δβ of the rope length corresponding to the working radius deviation ΔX and lift deviation ΔY.

Boom 4 of crane 1, having a prescribed length L, is rotated with prescribed angular velocity dα/dt, so the velocities dX/dt and dY/dt of the tip co-ordinate position of boom 4 can in general be found by the angular velocity $d\alpha/dt$ of the axis of rotation of boom 4, boom length L and the Jacobian matrix. Consequently, the deviation $\Delta\alpha$ of the boom hoisting angle can be found as follows, using the tip co-ordinate position deviation $\Delta X$, boom length L and the inverse Jacobian matrix.

$$\Delta\alpha=-(\Delta X/(L\cdot\sin\alpha)) \quad (3)$$

In the same way, the rope length deviation $\Delta\beta$ can be found by the following formula (4).

$$Db=(\Delta X/\tan\alpha)+\Delta Y \quad (4)$$

Deviation coordinate conversion section 22 calculates boom hoisting angle deviation $\Delta\alpha$ by substituting the currently input deviation $\Delta X$ and detected value a etc into formula (3) above and calculates rope length deviation $\Delta\beta$ by substituting deviation $\Delta X$ and detected value a etc that are currently input into formula (4) above.

In this way, when the boom hoisting angle deviation $\Delta\alpha$ has been calculated, this deviation $\Delta\alpha$ is input to deviation angle control section 23 and this deviation angle control section 23 calculates and generates a control signal $\alpha r$ such as to make this deviation $\Delta\beta$ zero, and this is then output to the boom control section of drive unit 30. This calculated rope length deviation $\Delta\beta$ is also input to rope length control section 24 and this rope length control section 24 calculates and generates a control signal $\beta r$ such as to make this deviation $\Delta\beta$ zero, and this is output to the winch drive section of drive unit 30.

Control signal $\alpha r$ is processed by a boom drive section that is built around a boom hoisting flow rate control valve 34.

First of all, control signal $\alpha r$ is supplied to solenoid 31*a* of electromagnetic proportional pressure control valve 31 for decreasing the boom hoisting angle or is supplied to solenoid 32*a* of electromagnetic proportional pressure control valve 32 for increasing the boom hoisting angle. Control valve 31 or 32 is thereby actuated, causing a hydraulic signal of pressure corresponding to the input electrical signal ar to be applied to pilot port 34*a* or 34*b* of flow rate control valve 34.

Pressurized oil discharged from a charging pump 37 is supplied to control valves 31 and 32.

If now we assume that control signal $\alpha r$ indicates "boom lowering", control valve 31 for lowering is actuated, and flow rate control valve 34 is shifted to valve position 34*c* corresponding to the magnitude of control signal $\alpha r$; this causes pressurized oil discharged from hydraulic pump 33 for raising or lowering to be supplied to retraction chamber 5*a* of hydraulic cylinder 5 with a flow rate corresponding to valve position 34*c*.

As a result, boom 4 is lowered in accordance with control signal $\alpha r$, and deviation $\Delta\alpha$ is made zero.

Also, if control signal $\alpha r$ is indicating "boom raising", in the same way, the corresponding control valve 32 is actuated, causing flow rate control valve 34 to move to valve position 34*d* corresponding to the magnitude of control signal $\alpha r$, with the result that pressurized oil discharged from hydraulic pump 33 for raising and lowering is supplied to extension chamber 5*b* of hydraulic cylinder 5 with a flow rate corresponding to this valve position 34*d*. As a result, boom 34 is raised corresponding to control signal $\alpha r$, and deviation $\Delta\alpha$ is made zero.

In contrast, control signal $\beta r$ is processed by the winch drive section, which is built around winch winding-up or lowering flow rate control valve 39. Control signal $\beta r$ is supplied to solenoid 35*a* of electromagnetic proportional pressure control valve 35 for winding up or solenoid 36*a* of like pressure control valve 36 for lowering. By this means, control valve 35 or 36 is actuated, causing a hydraulic signal of pressure corresponding to the input electrical signal br to be supplied to pilot port 39*a* or 39*b* of flow rate control valve 39.

Pressurized oil discharged from charging pump 37 is supplied to control valves 35, 36.

If now control signal $\beta r$ is indicating "winch winding up", control valve 34 for winding up is actuated, causing flow rate control valve 39 to be moved to valve position 39*c* corresponding to the magnitude of control signal $\beta r$, with the result that pressurized oil discharged from hydraulic pump 38 for the winch is supplied to the winding-up rotating side of hydraulic motor 40, with a flow rate corresponding to valve position 39*c*.

As a result, wind-up rope 8 is wound up corresponding to control signal $\beta r$, and deviation $\Delta\beta$ is made zero.

If control signal $\beta r$ is indicating "winch lowering", in the same way, the corresponding control valve 36 is actuated, causing flow rate control valve 39 to be shifted to valve position 39*d* corresponding to the magnitude of control signal $\beta r$, with the result that pressurized oil discharged from hydraulic pump 38 for the winch is supplied to the lowering rotational side of hydraulic motor 40 with a flow rate corresponding to valve position 39*d*.

As a result, wind-up rope 8 is lowered corresponding to control signal $\beta r$, and deviation $\Delta\beta$ is made zero.

Operation will now be described for the case where a so-called "ground breaking" operation is performed, in which for example a suspended load 6 at the ground is gradually raised, when the operation is performed varying lift Y while maintaining the working radius X of crane 1 fixed.

First of all, at the commencement of the ground breaking operation, it is desirable that the hook 9 should be set such that the weight of suspended load 6 comes directly under the point pin.

The operator then performs processing, for example by operating a start-control switch, to input working radius X0 at the start of control to control unit 20 as target value Xr. In contrast, in the case of lift Y, the operator would input to control unit 20 a target value Yr that gradually changes with progress of the ground-breaking operation.

Thereupon, the suspended load gets bigger while load 6 is getting closer to being raised in response to rope 8 being wound up by driving the winch corresponding to the Y direction instruction Yr. As a result, boom 4 gradually flexes, causing working radius X to increase and the lift Y in the calculation to alter.

Working radius X and lift Y that are changing with flexing of boom 4 in this way are calculated as described above by the coordinate conversion section 25.

Boom control signal $\alpha r$ and winch control signal $\beta r$ for target values X0, Yr are thereupon generated by control unit 20, using as feedback values the current values X, Y which are changing with this flexure; these control signals $\alpha$, $\beta r$ are simultaneously output to the boom drive section and winch drive section of drive unit 30, thereby simultaneously controlling the boom hoisting angle and the rope length.

As a result, a ground breaking operation in which suspended load 6 is raised can be carried out in a safe manner while keeping working radius X at a fixed value X0, without abrupt change of lift Y or causing flow of suspended load 6.

Also, operation can likewise be carried out in a safe way when performing an operation in which the load of suspended load 6 is made smaller while load 6 is still suspended, for example as in the case of a raw concrete pouring operation.

The action will now be described wherein conversely, operation is performed while varying the working radius X and keeping the lift Y of crane 1 fixed, for example a horizontal movement operation, in which suspended load 6 is displaced in the horizontal direction.

In this case, the operator performs processing, by for example operating a start-control switch, wherein the lift Y0 on start of control is input to control unit 20 as target value Yr. On the other hand, in the case of working radius X, processing is performed wherein target value Xr that progressively changes with progress of the horizontal movement operation is input to control unit 20.

When this is done, boom 4 is driven in accordance with the X direction instruction Xr, and the load applied to boom 4 fluctuates corresponding to the change in the boom hoisting angle α. This causes the flexure of boom 4 to gradually change, also changing working radius X and lift Y.

Working radius X and lift Y that change in this way depending on the flexure of boom 4 are calculated as described above by the coordinate conversion section 25.

Thereupon, boom control signal αr and winch control signal βr for achieving target values Xr and Y0 are generated by control unit 20, using as feedback quantities the current values X, Y, which are changing with the flexure amount, and these are simultaneously output to the boom drive section and winch drive section of drive unit 30, so that the boom hoisting angle and rope length are simultaneously controlled.

As a result, an operation of horizontal displacement in which suspended load 6 is displaced horizontally while maintaining lift Y at a fixed value Y0 can be performed safely.

INDUSTRIAL APPLICABILITY

As described above, with the present invention, the boom hoisting angle and the rope length can be controlled concurrently, using as feedback quantities the working radius and lift taking into account the current flexure of the boom, so an operation which advances by changing the lift while keeping the working radius at a fixed value or an operation which advances by changing the working radius while keeping the lift at a fixed value can be performed in a safe manner.

We claim:

1. Crane control device comprising:

boom drive means for changing a boom hoisting angle in response to an input drive instruction;

winch drive means for changing a rope length of the wind-up rope from a tip of the boom to a hook in response to the input drive instruction;

boom hoisting angle detection means for detecting the boom hoisting angle;

rope length detection means for detecting the rope length;

boom load detection means for detecting a load acting on the boom;

setting means for setting beforehand, taking the boom hoisting angle, boom load and boom length as parameters, a first correspondence relationship of these parameters and the working radius, and a second correspondence relationship of the parameters and the boom tip vertical position;

first calculating means for calculating a current working radius based on the detected values of the boom hoisting angle detection means and the boom load detection means, the value of the boom length and the first correspondence relationship that is set in the setting means, and for calculating a current lift based on a current boom tip vertical position and the detected value of the rope length detection means, the current boom tip vertical position being obtained based on the detected values of the boom hoisting angle detection means and the boom load detection means, the value of the boom length and the second correspondence relationship set in the setting means; and control means for outputting drive instructions respectively to the boom drive means and winch drive means such as to perform a prescribed operation wherein the lift, indicating the vertical distance from the ground to the hook is varied while maintaining the working radius, indicating the horizontal distance from the rotation center of the crane to the boom tip at a fixed value, while inputting as feedback quantities the current working radius and the current lift calculated by the first calculating means.

2. Crane control device according to claim 1, comprising:

input means for inputting a target value of the working radius and a target value of the lift;

second calculating means for calculating a boom hoisting angle deviation corresponding to a working radius deviation based on the working radius deviation, detected value of the boom hoisting angle detection means and the value of the boom length by obtaining the deviation of a working radius target value input by the input means and a current working radius calculated by the first calculating means, and for calculating a rope length deviation corresponding to the working radius deviation and the lift deviation based on the lift deviation, the working radius deviation and the detected values of the boom hoisting angle detection means by obtaining deviation between a lift target value that is input by the input means and current lift calculated by the first calculating means; and control means for outputting a drive instruction to the boom drive means such as to make the boom hoisting angle deviation calculated by the second calculating means zero and to the winch drive means such as to make the rope length deviation calculated by the second calculating means zero.

3. Crane control device comprising:

boom drive means for changing the boom hoisting angle in response to an input drive instruction;

winch drive means for changing the rope length of the wind-up rope from the boom tip to the hook in response to an input drive instruction;

boom hoisting angle detection means for detecting the boom hoisting angle;

rope length detection means for detecting the rope length;

boom load detection means for detecting a load acting on the boom;

setting means for setting beforehand, taking the boom hoisting angle, boom load and boom length as parameters, a first correspondence relationship of these parameters and the working radius, and a second correspondence relationship of the parameters and the boom tip vertical position; first calculating means for calculating a current working radius based on the detected values of the boom hoisting angle detection means and the boom load detection means, the value of the boom length and the first correspondence relationship that is set in the setting means, and for calculating a current lift based on a current boom tip vertical position and the detected value of the rope length detection means, the current boom tip vertical position being obtained based on the detected values of the boom hoisting angle detection means and the boom load detection means, the value of the boom length and the second correspondence relationship set in the setting means; and control means for outputting drive instructions respectively to the boom drive means and winch drive means such as to perform a prescribed operation by varying the working radius indicating the horizontal distance from the rotation center of the crane to the boom tip while maintaining the lift indicating the vertical distance from the ground to the hook at a fixed value, while inputting as feedback quantities the current working radius and the current lift calculated by the first calculating means.

4. Crane control device according to claim 3, comprising:

input means for inputting a target value of the working radius and a target value of the lift;

second calculating means for calculating a boom hoisting angle deviation corresponding to a working radius deviation based on the working radius deviation, detected value of the boom hoisting angle detection means and the value of the boom length by obtaining the deviation of a working radius target value input by the input means and a current working radius calculated by the first calculating means, and for calculating a rope length deviation corresponding to the working radius deviation and the lift deviation based on the lift deviation, the working radius deviation and the detected values of the boom hoisting angle detection means by obtaining deviation between a lift target value that is input by the input means and current lift calculated by the first calculating means;

control means for outputting a drive instruction to the boom drive means such as to make the boom hoisting angle deviation calculated by the second calculating means zero and to the winch drive means such as to make the rope length deviation calculated by the second calculating means zero.

* * * * *